US007586455B2

(12) United States Patent
Worl

(10) Patent No.: US 7,586,455 B2
(45) Date of Patent: Sep. 8, 2009

(54) METHOD AND APPARATUS FOR ANTENNA SYSTEMS

(75) Inventor: Robert T. Worl, Renton, WA (US)

(73) Assignee: The Boeing Company, Chicago, IL (US)

( * ) Notice: Subject to any disclaimer, the term of this patent is extended or adjusted under 35 U.S.C. 154(b) by 252 days.

(21) Appl. No.: 11/734,228

(22) Filed: Apr. 11, 2007

(65) Prior Publication Data

US 2008/0252540 A1 Oct. 16, 2008

(51) Int. Cl.
*H01Q 13/00* (2006.01)

(52) U.S. Cl. ..... 343/786; 343/772

(58) Field of Classification Search ..... 343/772, 343/876; 333/21 A, 136, 137
See application file for complete search history.

(56) References Cited

U.S. PATENT DOCUMENTS

| | | | | | |
|---|---|---|---|---|---|
| 3,605,100 | A * | 9/1971 | Parad | ..... | 343/777 |
| 4,041,499 | A * | 8/1977 | Liu et al. | ..... | 343/756 |
| 4,709,240 | A * | 11/1987 | Bordenave | ..... | 343/772 |
| 5,245,353 | A * | 9/1993 | Gould | ..... | 343/786 |
| 6,426,729 | B2 * | 7/2002 | Yoshida et al. | ..... | 343/786 |
| 6,989,791 | B2 | 1/2006 | Navarro et al. | | |

* cited by examiner

*Primary Examiner*—Tan Ho
(74) *Attorney, Agent, or Firm*—Klein, O'Neill & Singh, LLP

(57) ABSTRACT

An Electronically Scanned Antenna (ESA) element and method for same, is provided. The element includes at least two RF probe pairs operating at different frequencies in a single waveguide aperture. One RF probe pair operates at a higher frequency than the other RF probe pair; and the RF probe pairs generate circular polarized waves.

17 Claims, 8 Drawing Sheets

METHOD AND APPARATUS FOR ANTENNA SYSTEMS

CROSS REFERENCE TO RELATED APPLICATIONS

None

BACKGROUND

1. Field of the Invention

This disclosure is related to antenna systems, and more specifically to Electronically Scanned Antenna (ESA) systems that can operate in multiple frequency bands.

2. Related Art

Communications systems today use plural antenna systems to communicate in multiple frequency bands. These systems often also desire the use of full-duplex operation, i.e. the ability to transmit and receive at the same time. Currently, these antenna systems use a plurality of antenna subsystems, one for frequency of operation, and one for each transmit and receive function.

As the number of frequency bands where antenna systems are operated increase, so do the number of different antenna subsystems. These antenna subsystems are high-cost, heavy, and space-consuming.

It is desirable to reduce the number of antenna subsystems by combining the functions of several subsystems into a single antenna system. Conventional ESA systems today support only half solutions, i.e. half-duplex, single frequency band operation from a single radiating aperture. Therefore, an antenna system is needed that supports multi frequency band operation in full-duplex mode of operation from a single radiating aperture.

SUMMARY

In one aspect, an Electronically Scanned Antenna (ESA) system radiating element is provided. The ESA radiating element includes at least two RF probe pairs operating in different frequency bands in a single aperture. One RF probe pair operates at a higher frequency than the other RF probe pair; the RF probe pairs generate circularly polarized waves at each frequency band.

In another embodiment, a method for operating an antenna system is provided. The method includes operating at least two RF probe pairs of an antenna element at different frequencies in a single waveguide aperture; wherein one RF probe pair operates at a higher frequency than the other RF probe pair.

This brief summary has been provided so that the nature of the invention may be understood quickly. A more complete understanding of the invention may be obtained by reference to the following detailed description of embodiments thereof in connection with the attached drawings.

BRIEF DESCRIPTION OF THE DRAWINGS

The foregoing and other features of the embodiments will now be described with reference to the drawings. In the drawings, the same components have the same reference numerals. The illustrated embodiment is intended to illustrate the adaptive aspects of the present disclosure. The drawings include the following FIGS..

DETAILED DESCRIPTION

Definitions:

The following definitions are provided as they are typically (but not exclusively) used in relation to electromagnetic radiation, as referred to by various aspects of the present disclosure.

"Circular polarized wave" is an electromagnetic wave that is composed of radiant energy in two orthogonal planes that are 90 degrees out of phase with each other. In a circular polarized antenna, the polarization vector rotates in a circle making one complete revolution during one period of the wave.

"Frequency band" is a specific range of frequencies in the radio frequency (RF) spectrum, where each band has a defined upper and lower frequency limit, for example, K band 18-26 GHz and Ka band 26-40 GHz.

"Transverse mode" describes a radiation pattern for electromagnetic waves. When a wave travels in a waveguide, the wave's radiation pattern is determined by the properties of the waveguide. The resulting radiation intensity pattern, which is in a plane perpendicular to wave propagation, is called the "transverse mode."

"TE mode" (transverse electric mode) of a wave means that there is no electric field in the direction of wave propagation.

"TM mode" (transverse magnetic mode) of a wave means there is no magnetic field in the direction of wave propagation.

Standing wave ratio (SWR) is the ratio of the maximum amplitude and the minimum amplitude of a partial standing wave at a maximum node (point). SWR is usually defined as a voltage ratio, called the "VSWR" (voltage standing wave ratio).

The present disclosure provides an antenna element for an electronically scanned antenna system. The antenna element uses multiple RF probes that are formed on a multi-layer printed wiring board. The antenna system is capable of producing multiple-beams, each at different frequency band from the same aperture. Vias are arranged circumferentially around at least two pairs of RF probes to form circular waveguides. This construction method significantly reduces components for electronically scanned antenna systems.

Figure 1:
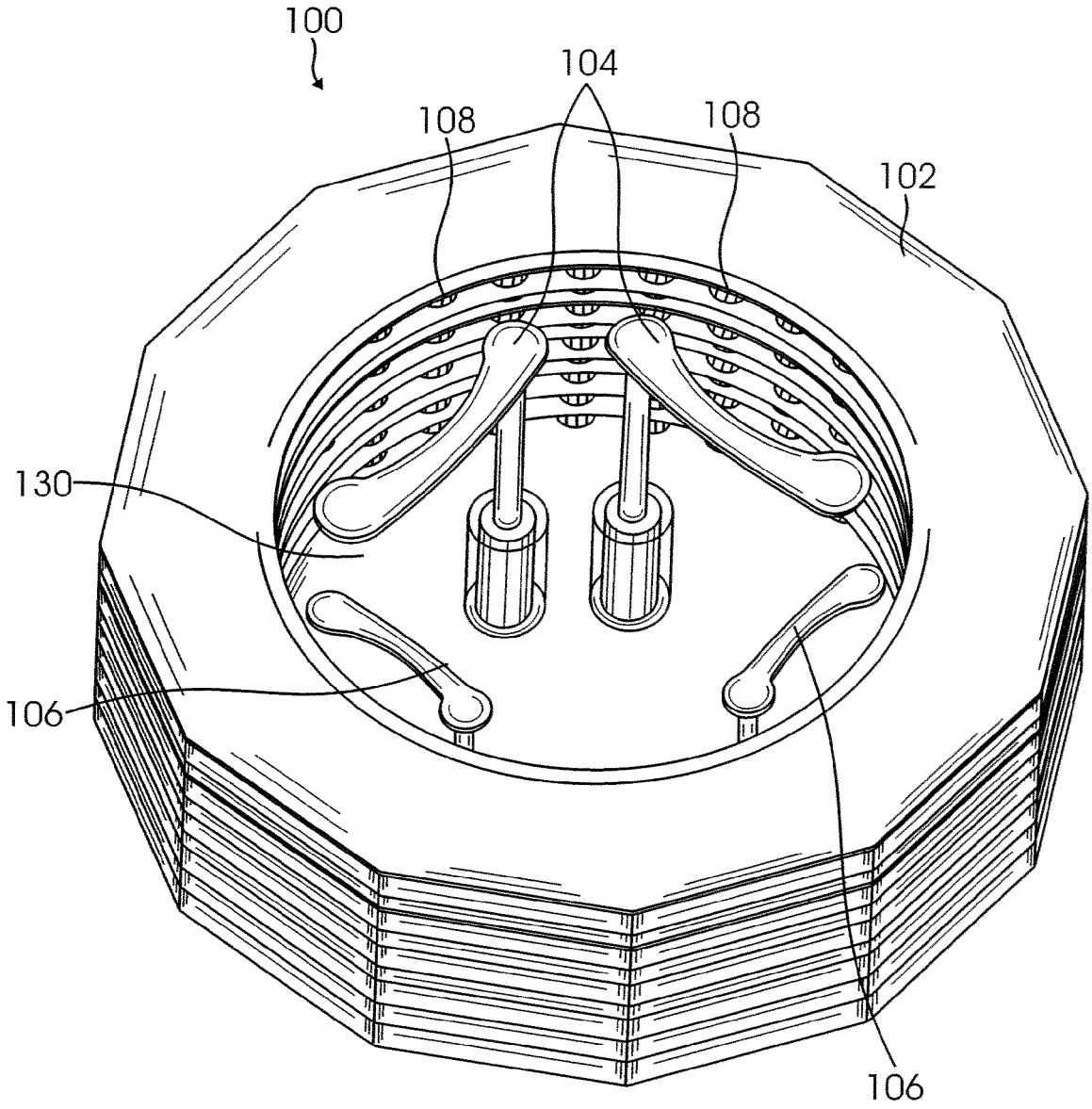
FIG. 1 is a perspective view of a shared aperture electronically scanned antenna (ESA) element, according to one embodiment.
Figure 3:
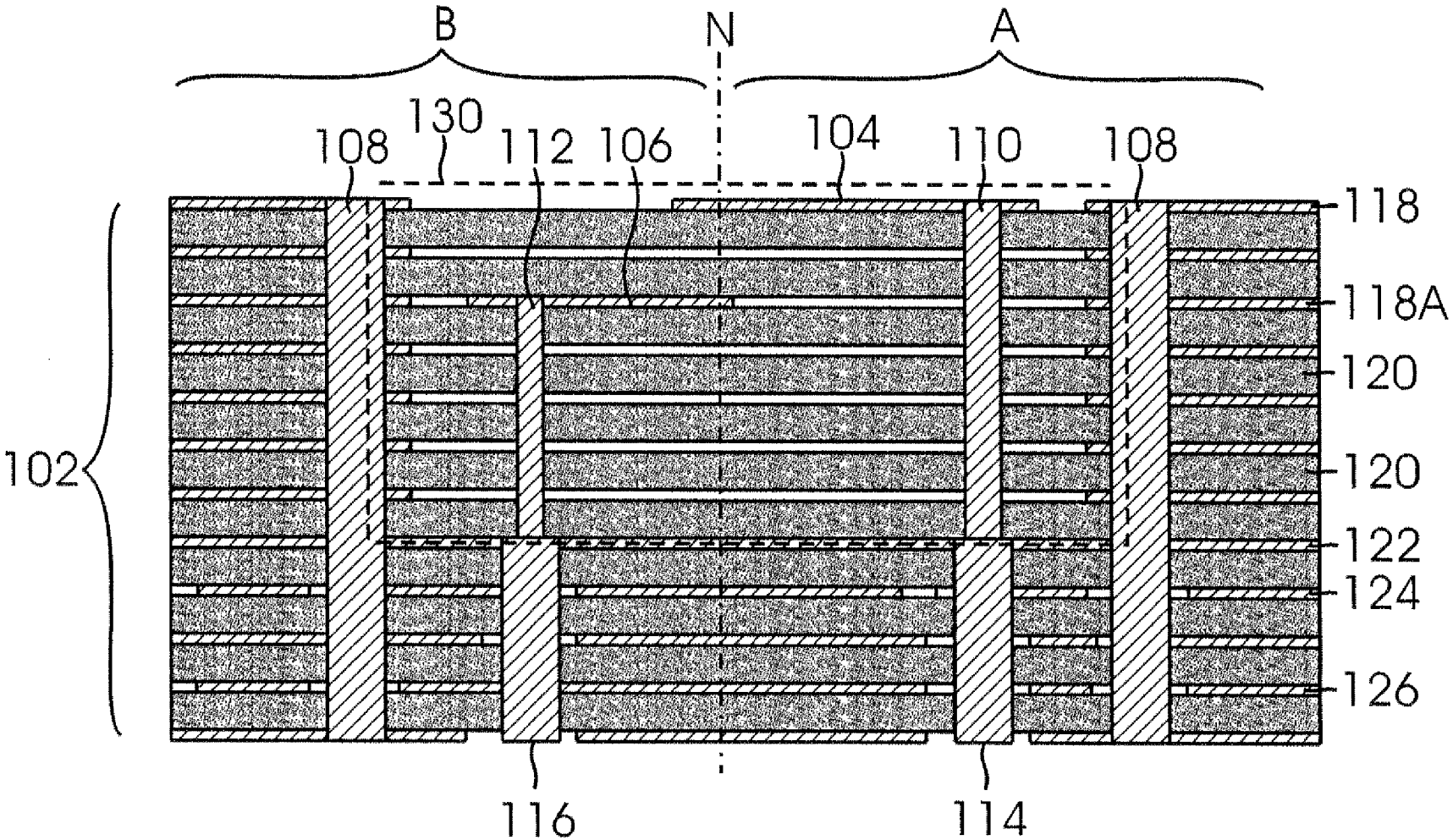
FIG. 3 shows a detailed cross sectional view of the shared aperture ESA element, according to an embodiment.

FIG. 1 shows a single shared aperture electronically scanned antenna element 100 (hereinafter "antenna element 100") fabricated as a multi-layer printed wiring board 102 (hereinafter "PWB 102"), in accordance with an embodiment of the present disclosure. PWB 102 includes a plurality of integrally formed circular waveguides 130 (only one shown). Waveguide 130 is formed by plated trough-hole vias (shown as 108) and a metal layer 122 (FIG. 3). Within each circular waveguide 130, there are two pairs of RF probes, a low-band (or low frequency band) pair 104, radiating signal at a lower frequency band (for example, the K band), and a high band (or high frequency bad) pair 106, radiating signal at a higher frequency band (for example, the Ka band). The low-band pair 104, is visible on outer-layer 118 (See FIG. 3), while the high-band pair 106, is on internal layer 118A (See FIG. 3)

Figure 2:
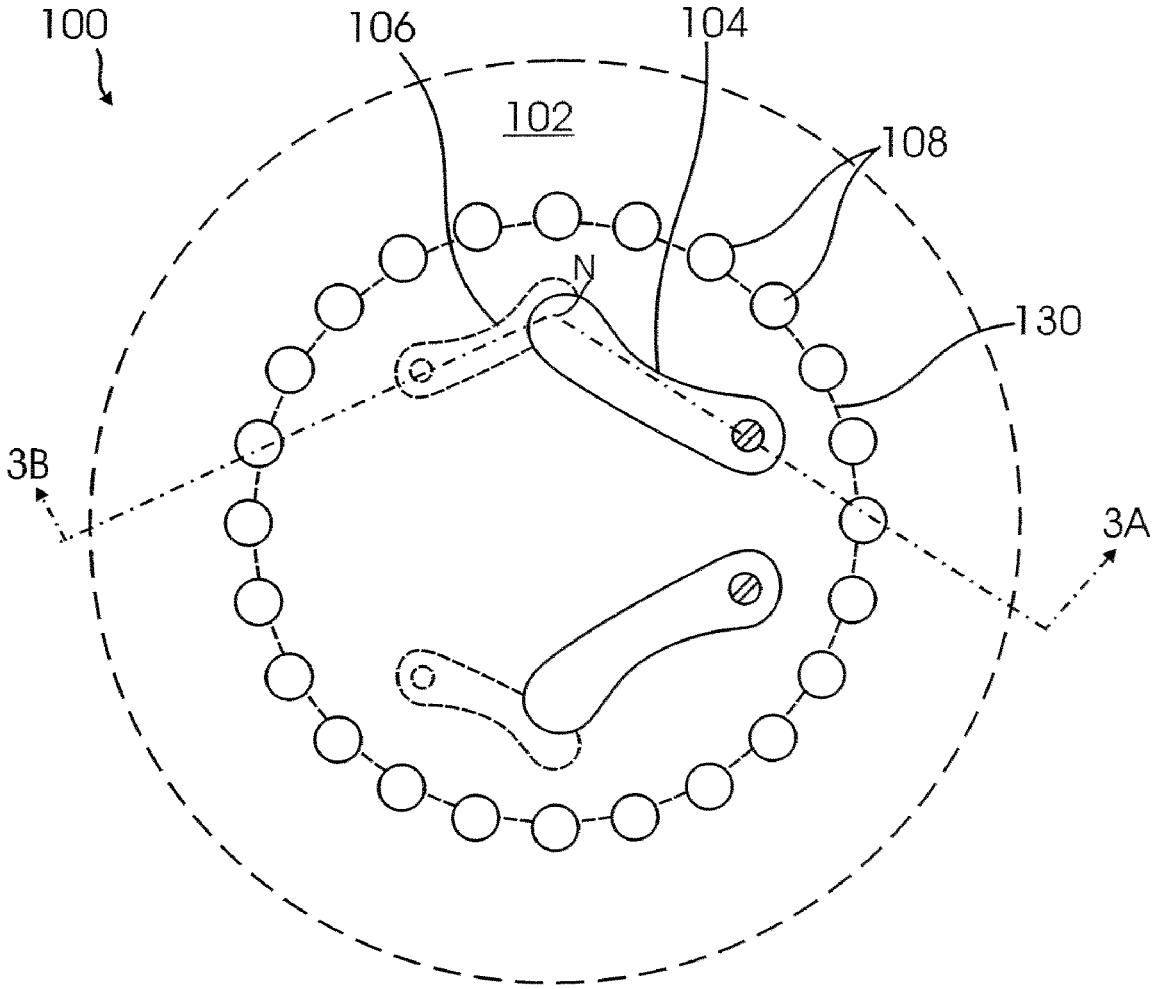
FIG. 2 shows a top view of the shared aperture ESA element, according to an embodiment.

FIGS. 2-3 show a detailed view of the antenna element 100, which includes PWB 102. PWB 102 is formed by laminating a plurality of conductive layers 118, 122 and dielectric layers 120 using industry standard PWB processing techniques. Vias 108 are arranged circumferentially around RF probes 104, and 106, to effectively form an outside surface of waveguide 130. Vias 108 are electrically connected to metal ground layer 118, while metal layer 122, forms a backshort of waveguide 130.

Typically, an antenna element only needs one RF probe per waveguide to operate. However, a pair of identical RF probes may be used to generate controlled circularly polarized waves. The additional pair of probes within the same aperture with different geometry facilitates multi-frequency band operation, which may result in full-duplex mode of operation.

RF probes 104 are electrically connected thru vias 110 to an impedance matching and filtering RF signal layer 124 or to an alternate feed point, stem 114, RF probes 106 are electrically connected, thru vias 112, to an impedance matching RF signal layer 126, or to an alternate feed point, stem 116. Through signal layers 124 and 126, or from alternate feed points 114 and 116, RF probes 104 and 106 are coupled to the rest of an antenna system (not shown).

FIGS. 4A-4F illustrates dimensional attributes of PWB 102 that determine overall electrical characteristics of antenna element 100. The final dimensions are based on an optimization process and may be iterative where both high-band (106) and low-band (104) probe geometries are adjusted until an acceptable performance criterion is met. The optimization process is used to determine final geometries that support radiation and reception of circularly polarized waves in TE11 mode at different frequency bands. The optimization may be performed using standard commercial software products for electromagnetics, for example, Ansoft's High Frequency Simulation Suite or CST's Microwave Studio.

Figure 4A:
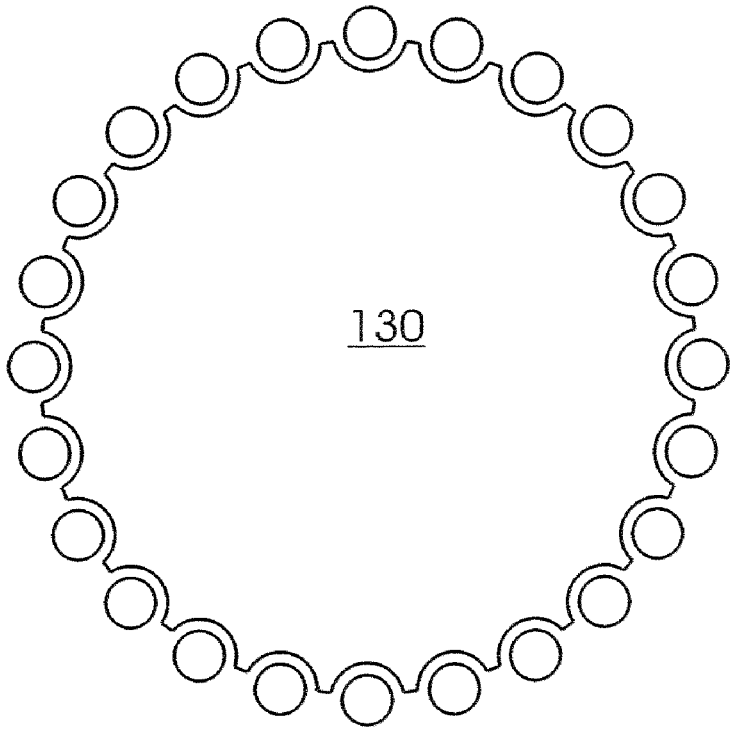
FIGS. 4A-4F show dimensional attributes of a shared aperture ESA element, according to an embodiment.
Figure 4B:
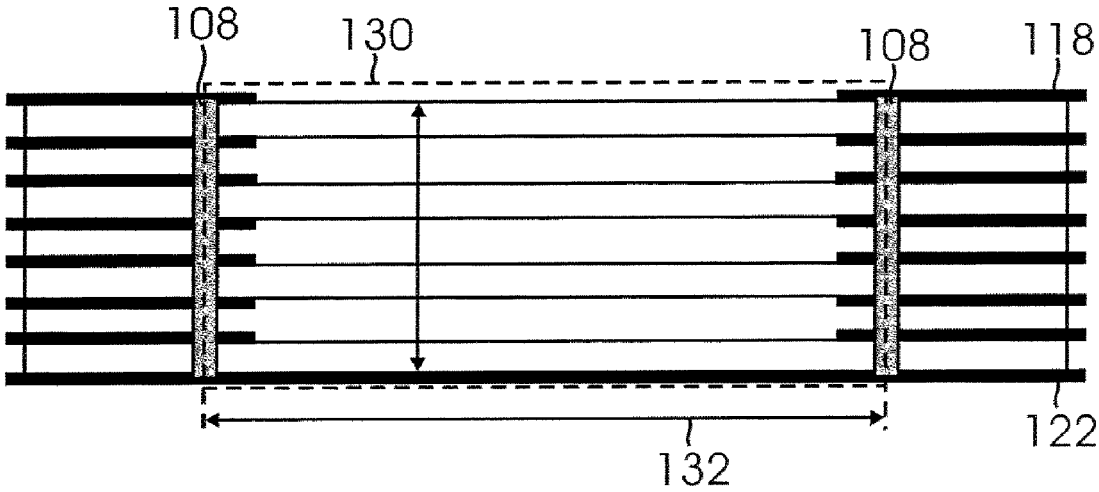

FIG. 4A shows a top-view of a waveguide 130. FIG. 4B shows a cross-sectional view of waveguide 130 where the radiating aperture 132 (also referred to as diameter 132) is selected. In one embodiment, diameter 132 may be 0.7 $\lambda 1$, where $\lambda 1$ is the wavelength of a low band frequency signal. Because a waveguide has a natural high-pass response, with the selected diameter 132, a low frequency band signal can propagate in TE11 mode. The optimization also allows one to use a minimal value for diameter 132, which allows one to maximize antenna scan performance in an antenna array environment through tighter lattice spacing.

Probes 104 and 106 are designed to operate in TE11 mode. For each frequency band, the probe pairs 104 and 106 are isolated (See FIG. 4C and FIG. 4E). The size of waveguide 130 is selected for low-band operation just above the waveguide's cutoff. In one embodiment, the use of dielectric material 120, allows one to reduce diameter 132 depending on the dielectric constant of dielectric material 120.

Figure 4C:
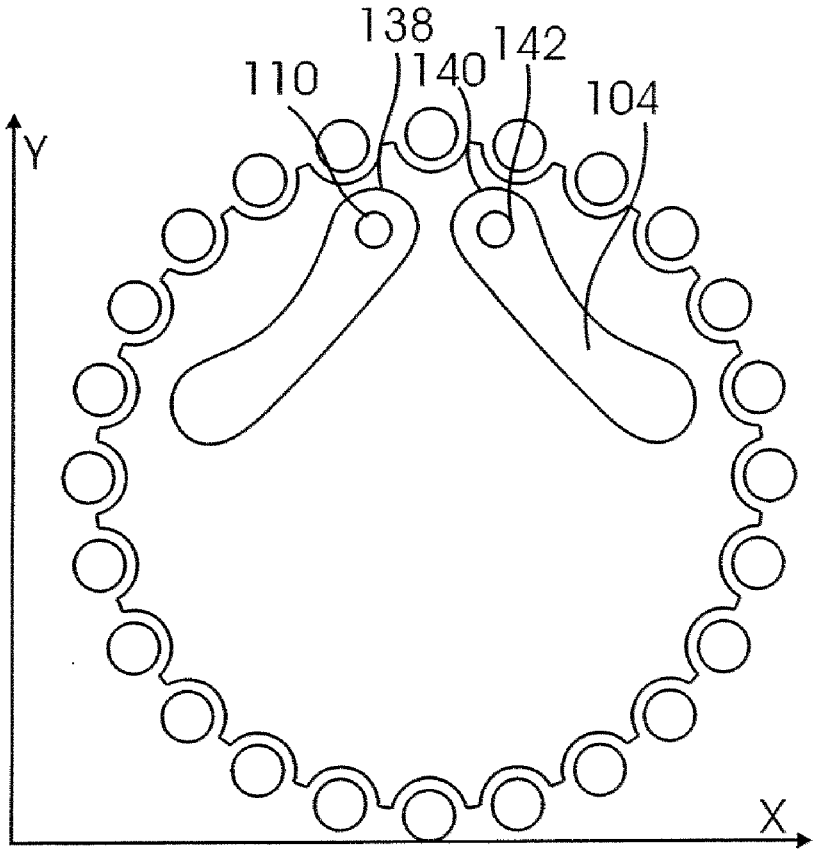

FIG. 4C shows a top-level diagram of waveguide 130 with RF probes 104 operating in a low frequency band. Probe pair 104's final locations 138, 140 and 142 are determined by software optimization.

Figure 4D:
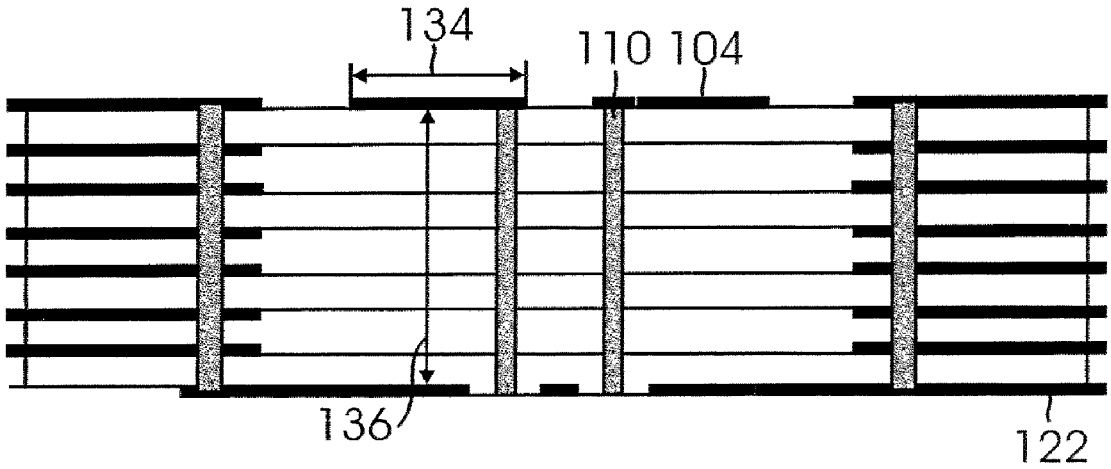

FIG. 4D shows a cross-sectional of view guide 130 where distance 136 is the distance between probe 104, and backshort 122. In one embodiment, distance 136 may be ⅓ $\lambda 1$. Probe 104 length is shown as 134 and may be ⅓ $\lambda 1$. All dimensions are finally determined through software optimization.

Figure 4E:
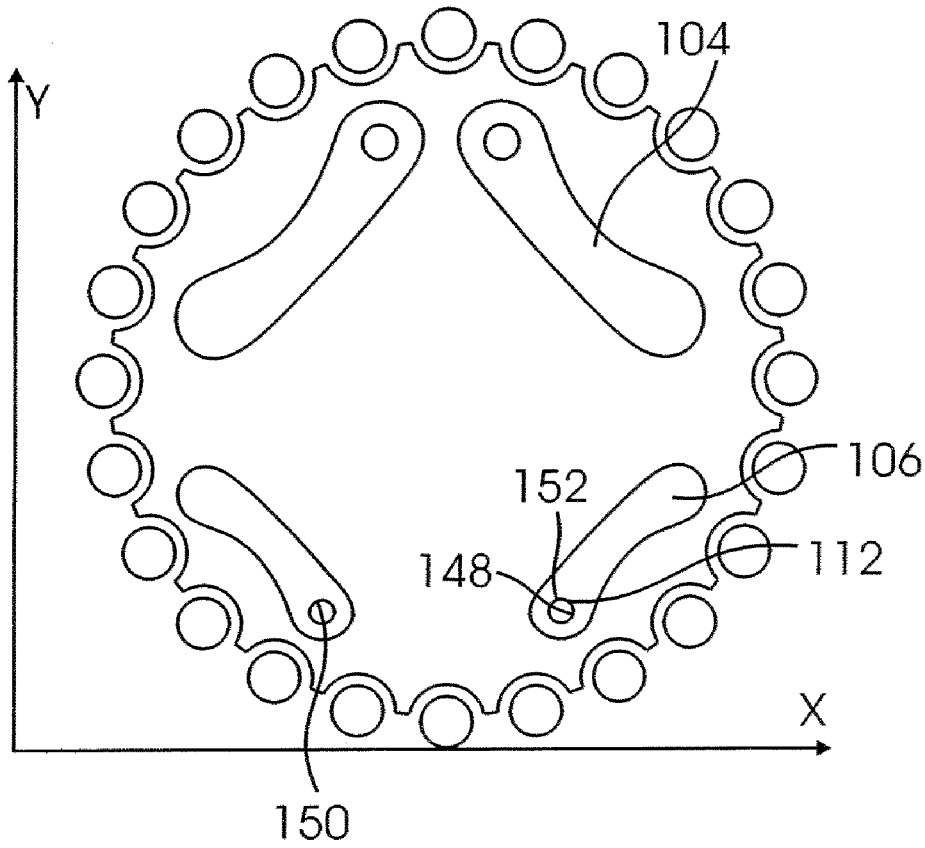

FIG. 4E shows a top-level diagram of waveguide 130 with RF probes 106 operating in a high frequency band. Probe pair 106's final locations 148, 150, and 152 are determined by software optimization.

Figure 4F:
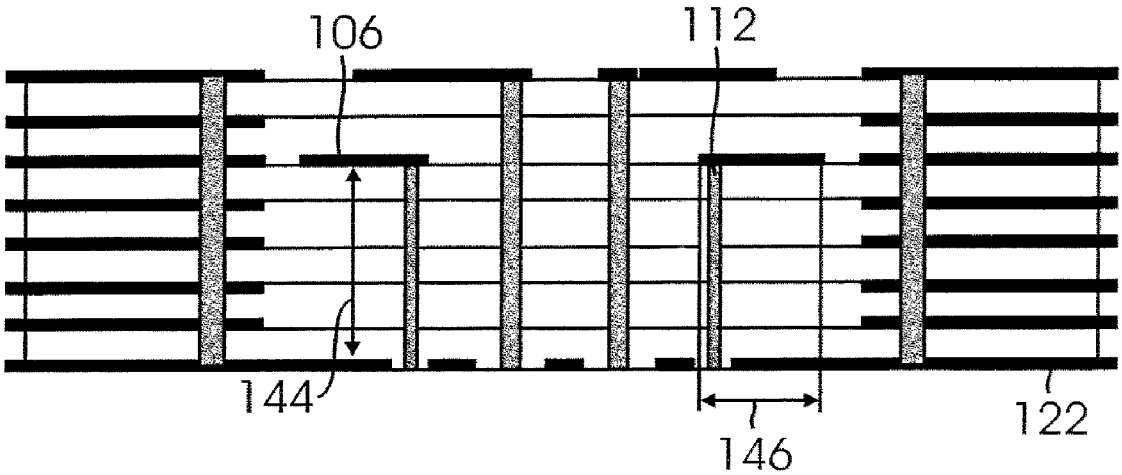

FIG. 4F shows a cross-sectional view of waveguide (FIG. 4E). Distance 144 is the distance between high-band probe 106, and backshort 122. Distance 144 may be ⅓ $\lambda 2$, where $\lambda 2$ is the wavelength of the high frequency band. Probe 106 length 146 may also be ⅓ $\lambda 2$. All dimensions are finally determined through software optimization.

As the operating frequency of antenna element 100 increases, the thickness of wiring board 102 will decrease. Conversely, as the operating frequency decreases, the thickness of the board 102 will increase. Having a dielectric material within the waveguide with higher dielectric constant than air also helps to reduce the size of antenna element 100.

Figure 5:
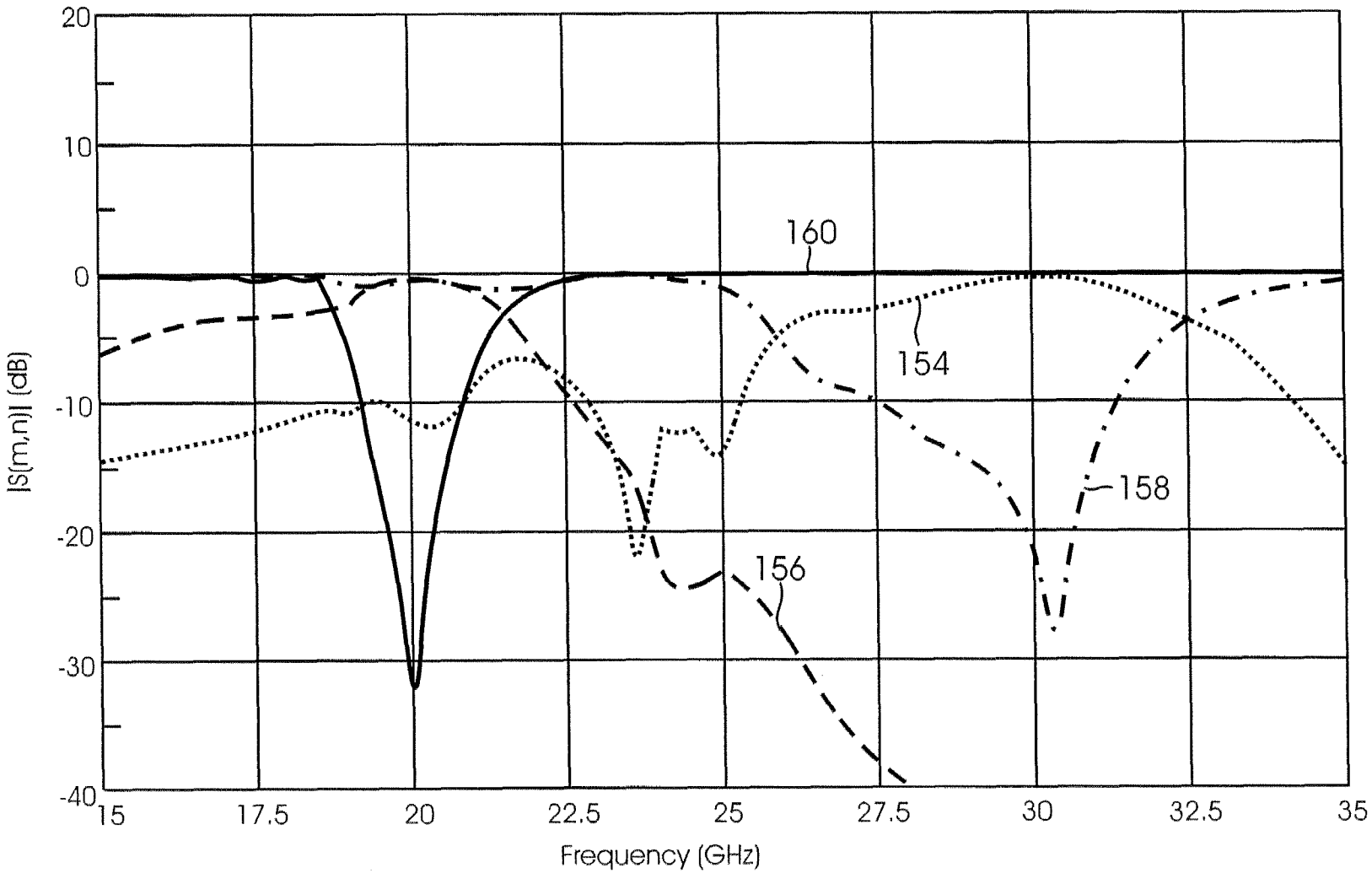
FIG. 5 graphically illustrates return loss and insertion loss for low frequency band and high frequency band probes.

FIG. 5 graphically illustrates low pass filtered antenna radiator responses. Trace 160 shows return loss for low frequency band probes 104. Trace 158 shows return loss for high frequency band probes 106. Trace 154 shows insertion loss for low frequency band probes 104, and trace 158 shows insertion loss for high frequency band probes 106. The results show that 1.5:1 VSWR impedance bandwidths are 5.7% for probes 104 and 5.8% for probes 106, while insertion loss is less than 0.5 dB.

Figure 6:
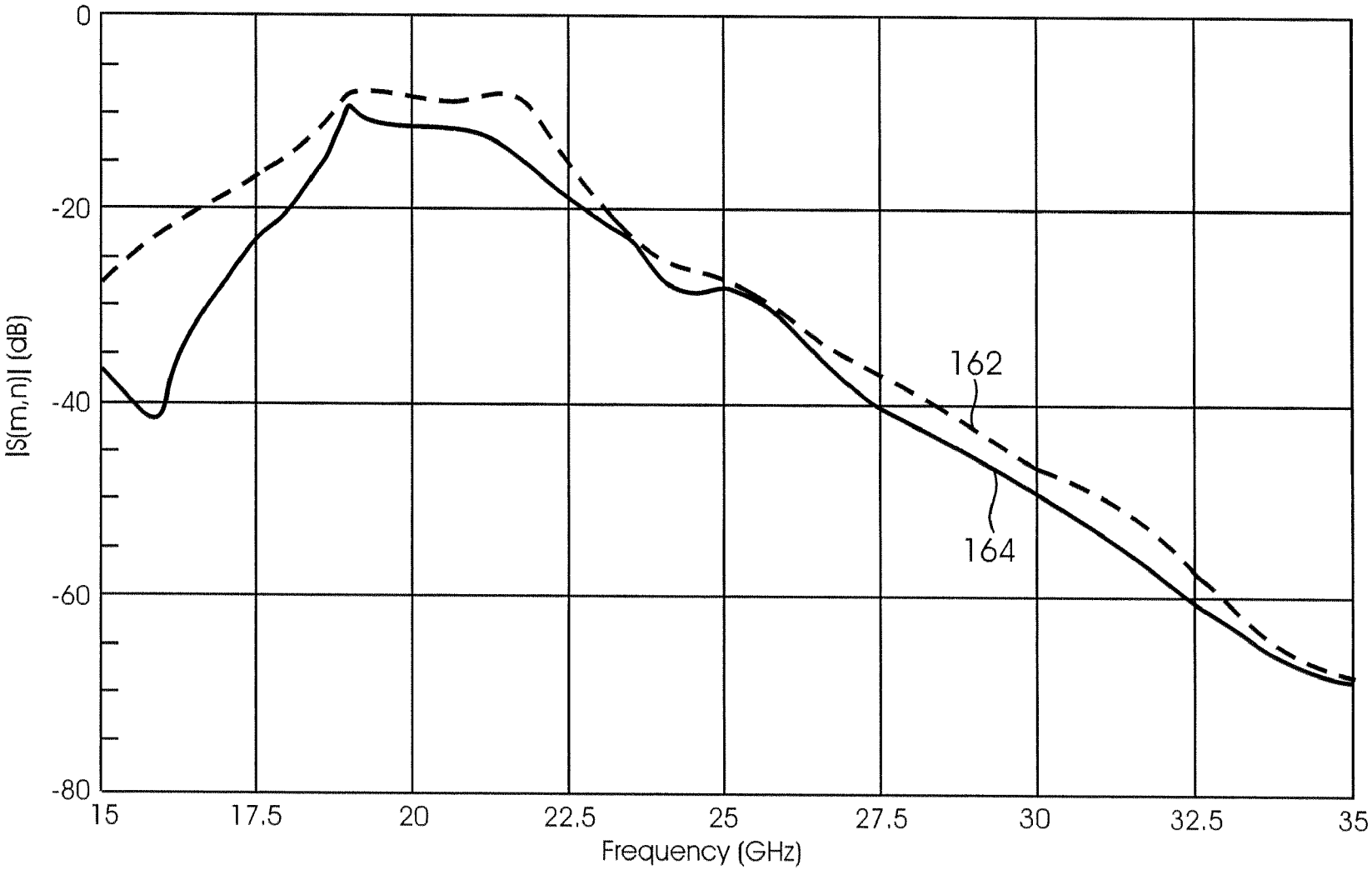
FIG. 6 graphically illustrates band isolation for low frequency band probes from a high frequency band probe.

FIG. 6 graphically illustrates band isolations for antenna radiator responses with low pass filters implemented on low-band probes 104. Band isolations are shown by traces 162 and 164. The low-band probes 104 are isolated from the high-band probes 106 by >46 dB, at a high frequency operation.

In one aspect, the present disclosure provides a RF antenna system with simultaneous support of multi-frequency and full-duplex mode of operation from a single radiating aperture. In another embodiment, the foregoing approach significantly reduces assembly time. Furthermore, by providing impedance controlled signal environment throughout a signal propagation path, higher operating frequencies can also be achieved.

Although the present disclosure has been described with reference to specific embodiments, these embodiments are illustrative only and not limiting. Many other applications and embodiments of the present disclosure will be apparent in light of this disclosure and the following claims.

What is claimed is:

1. A shared-aperture electronically scanned antenna element, comprising:

a plurality of plated through-hole vias arranged in a circle to effectively form an outside surface of a single waveguide aperture;

a first pair of radio frequency (RF) probes disposed within the single waveguide aperture, the first RF probe pair radiating a first RF signal in a first RF band; and a second pair of RF probes disposed within the single waveguide aperture, the second RF probe pair radiating a second RF signal in a second RF band that is different from the first RF band.

2. The antenna element of claim 1, wherein the first RF probe pair operates at a higher frequency than the second RF probe pair.

3. The antenna element of claim 1, wherein the RF probe pairs generate circular polarized waves, propagating in a TE11 mode.

4. The antenna element of claim 1, wherein the RF probes are placed in a configuration that minimizes unwanted propagation modes.

5. The antenna element of claim 1, wherein the diameter of the waveguide is about 0.7 of a wavelength of one of the first and second RF bands.

6. The antenna element of claim 5, wherein the depth of the waveguide is about one-third of the wavelength of one of the first and second RF bands.

7. The antenna element of claim 1, wherein the antenna element is part of a phased array antenna.

8. The antenna element of claim 1, wherein multi-frequency band operation of the antenna element results in full duplex mode of operation.

9. A method for operating a shared-aperture electronically scanned antenna element, the method comprising:

operating the antenna element including a plurality of plated through-hole vias arranged in a circle to effectively form an outside surface of a single waveguide aperture, a first pair of radio frequency (RF) probes disposed within the single waveguide aperture, and a second pair of RF probes disposed within the single waveguide aperture;

wherein the RF probe pairs operate at different frequencies in the single waveguide aperture.

10. The method of claim 9, wherein the RF probe pairs generate circular polarized waves, propagating in a TE11 mode.

11. The method of claim 9, wherein the RF probes are placed in a configuration that minimizes unwanted propagation modes.

12. The method of claim 9, wherein a plurality of vias are arranged circumferentially around the RF probes to effectively form an outside surface of the waveguide aperture.

13. The method of claim 12, wherein the diameter of the waveguide aperture is about 0.7 of a wavelength of a lower frequency band.

14. The method of claim 13, wherein the depth of the waveguide is about one-third of the wavelength of a lower frequency band.

15. The method of claim 9, wherein the antenna element is part of a phased array antenna.

16. The method of claim 9, wherein the first RF probe pair radiates a first RF signal in a first RF band.

17. The method of claim 16, wherein the second RF probe pair radiates a second RF signal in a second RF band that is different from the first RF band.

* * * * *